US011549667B1

(12) United States Patent
Liu et al.

(10) Patent No.: US 11,549,667 B1
(45) Date of Patent: Jan. 10, 2023

(54) LIGHTING DEVICE

(71) Applicant: JULUEN ENTERPRISE CO., LTD., New Taipei (TW)

(72) Inventors: Chao-Ching Liu, New Taipei (TW); Jen-Hao Cheng, New Taipei (TW); Chih-Chieh Lu, New Taipei (TW)

(73) Assignee: JULUEN ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 17/881,643

(22) Filed: Aug. 5, 2022

(51) Int. Cl.

| | |
|---|---|
| ***F21V 19/00*** | (2006.01) |
| ***F21S 8/00*** | (2006.01) |
| ***F21V 21/02*** | (2006.01) |
| ***F21Y 115/10*** | (2016.01) |

(52) U.S. Cl.
CPC ..... *F21V 19/003* (2013.01); *F21S 8/00* (2013.01); *F21V 19/0025* (2013.01); *F21V 21/02* (2013.01); *F21Y 2115/10* (2016.08)

(58) Field of Classification Search
CPC ..... F21V 19/003; F21V 19/0025; F21S 8/00
USPC ..... 362/249.01
See application file for complete search history.

(56) References Cited

U.S. PATENT DOCUMENTS

| | | | | |
|---|---|---|---|---|
| 2010/0002438 | A1* | 1/2010 | Zhang | F21V 29/75 362/249.02 |
| 2016/0369958 | A1* | 12/2016 | Kohshima | F21S 8/00 |
| 2022/0178506 | A1* | 6/2022 | Amin | F21V 5/02 |

* cited by examiner

*Primary Examiner* — Karabi Guharay

(57) ABSTRACT

A lighting device includes a housing, a light emitting module, a press plate and a fixing member. The housing has a bottom plate, a base and multiple stopping portions. The base protrudes from the bottom plate, and has a top surface and an inclined surface. The stopping portions are arranged at the bottom plate and extend to a bottom portion of the inclined surface of the base. The light emitting module includes a light panel and multiple light emitting elements arranged thereon. The light panel leans on the inclined surface and stopped by the stopping portions. The press plate is located at the top surface, and presses against the light panel. The fixing member fixes the press plate at the top surface to cause the press plate to press the light panel downward, so as to fix the light panel on the inclined surface.

13 Claims, 4 Drawing Sheets

LIGHTING DEVICE

BACKGROUND OF THE INVENTION

1. Field of the Invention

The present disclosure provides a lighting device, and in particular to a combined lighting device.

2. Description of the Related Art

Lighting devices of light emitting diodes have become the mainstream in the recent years. A lighting apparatus is usually provided with a light panel therein, and the installation of the light panel requires numerous screws, leading to time-consuming and labor-consuming installation of such light panel.

BRIEF SUMMARY OF THE INVENTION

With extensive research and development, the applicant provides a lighting device in the aim of achieving the object of convenient installation of a light panel.

A lighting device provided by the present disclosure includes a housing, a light emitting module, a press plate and a fixing member. The housing has a bottom plate, a base and a plurality of stopping portions. The base protrudes from one side of the bottom plate, and has a top surface and an inclined surface connected between the top surface and the bottom plate. The stopping portions are arranged at the bottom plate and extend to a bottom portion of the inclined surface of the base. The light emitting module includes a light panel and a plurality of light emitting elements arranged on the light panel. The light panel leans on the inclined surface and has stopped portions corresponding to the stopping portions. The press plate is located at the top surface, and presses against the other side opposite to the side of the light panel of the lighting emitting module provided with the stopped portions. The fixing member fixes the press plate at the top surface to cause the press plate to press the light panel downward, so as to fix the light panel on the inclined surface.

In one embodiment, the press plate is a control circuit board, and has a plurality of solder bumps on one side opposite to the light panel. The solder bumps and the light panel are electrically connected by a plurality of solder portions in between.

In one embodiment, each of the stopping portions includes a first part protruding from the bottom plate, and a second part extending from the first part and protruding from the inclined surface, and each of the stopped portions is a concave portion corresponding to the second part of each stopping portion.

In one embodiment, two sides of the second part are leaned against by two sides of the corresponding stopped portion.

In one embodiment, a side surface of the second part is an arc surface, and each of the stopped portion is an arc recess.

In one embodiment, a top portion of the second part has a press protrusion, so as to press against a top surface of the light panel when the stopped portions and the stopping portions are mutually stopped in position.

In one embodiment, a top portion of the inclined surface is provided with a limiting portion.

In one embodiment, the limiting portion has a limiting surface at an angle different from that of the inclined surface.

In one embodiment, the limiting surface is perpendicular to the top surface.

In one embodiment, a corner of the light panel close to the top surface is in alignment with the top surface, and the corner is pressed by the press plate.

In one embodiment, the top surface of the base has a fixing hole, the press plate has a through hole, and the fixing member passes through the fixing hole and is fixed at the fixing hole.

In one embodiment, the fixing hole is a screw hole, and the fixing member is a screw.

In one embodiment, the top surface is provided with a plurality of guiding protrusions, and the press plate has corresponding guiding through holes, such that the through hole is located right above the fixing hole when the press plate is placed at the top surface.

Regarding the assembly of the lighting device of the present disclosure, the light panel may be first placed on the inclined surface, the stopped portions and the stopping portions are mutually stopped in position, the press plate is placed at the top surface, and then the press plate is fixed at the top surface by the fixing member, hence quickly and conveniently fixing the light panel at the base, so as to solve the issue of being time-consuming and labor-consuming caused by locking of screws one after another during the installation of a light panel in the prior art.

DETAILED DESCRIPTION OF THE INVENTION

To facilitate understanding of the object, characteristics and effects of this present disclosure, embodiments together with the attached drawings for the detailed description of the present disclosure are provided.

Figure 1:
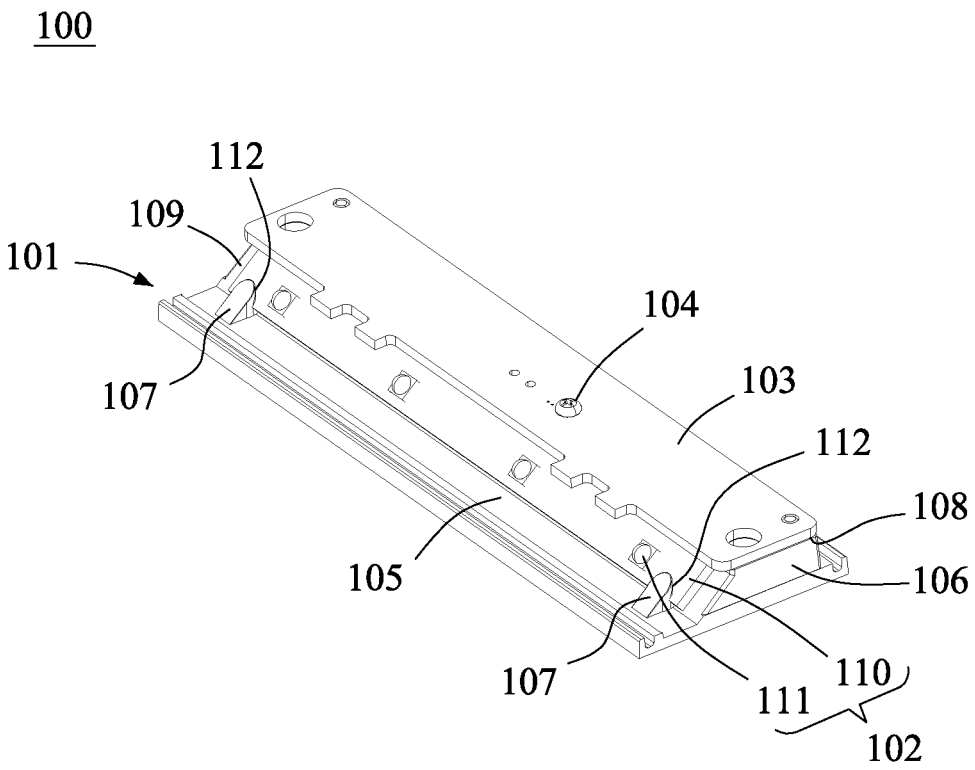
FIG. 1 is a first perspective schematic diagram of a lighting device according to a specific embodiment of the present disclosure.
Figure 2:
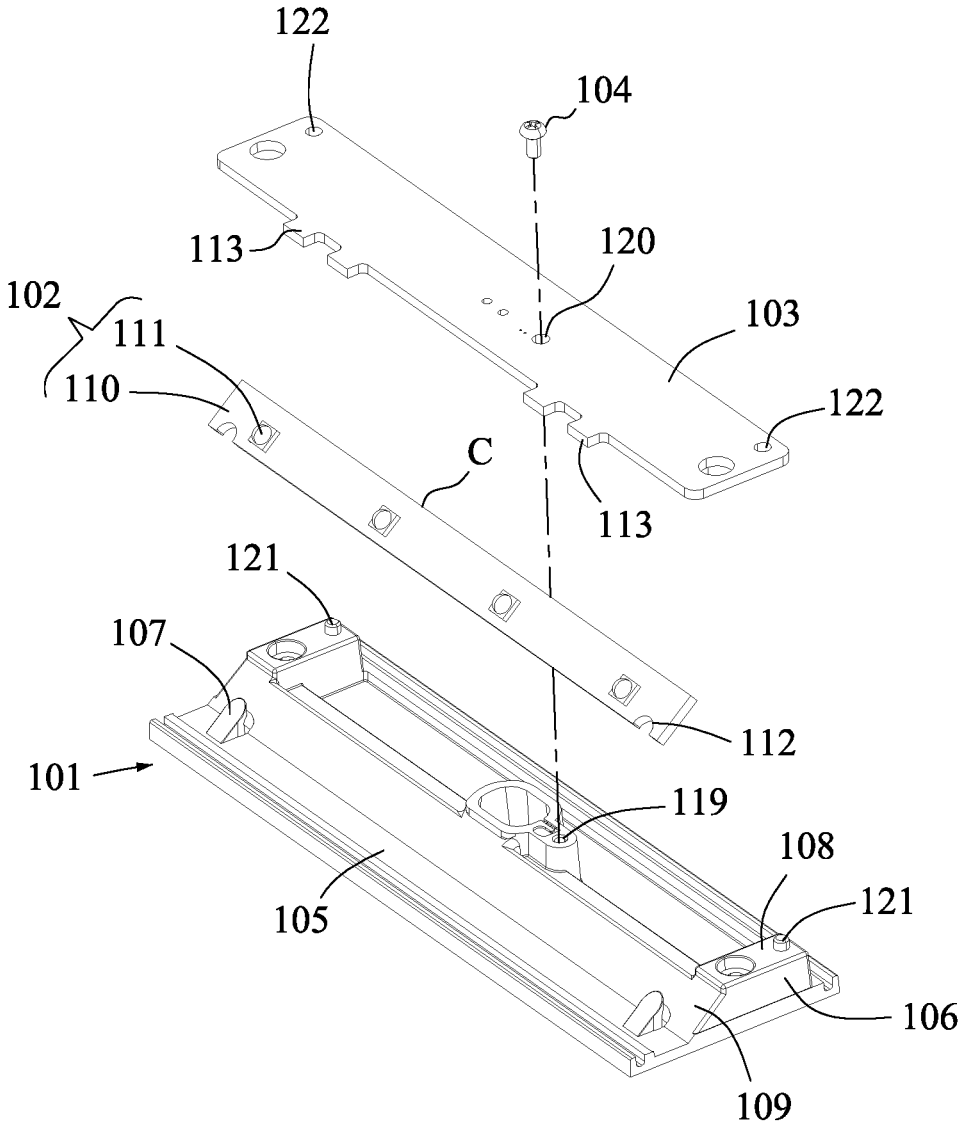
FIG. 2 is an exploded schematic diagram of a lighting device according to a specific embodiment of the present disclosure.
Figure 3:
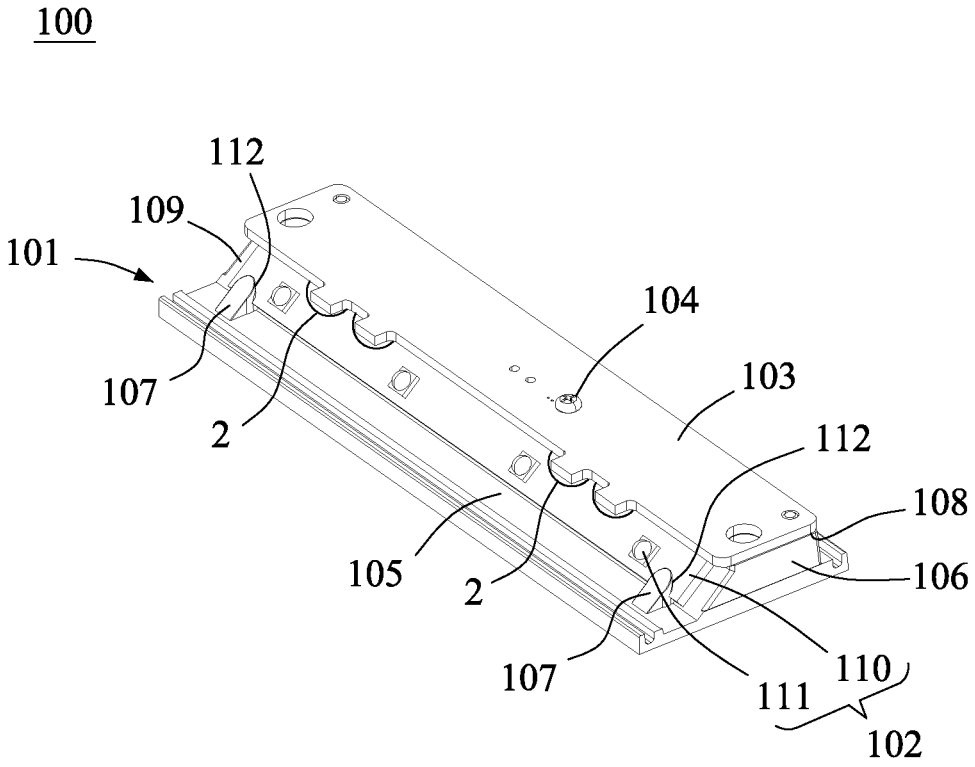
FIG. 3 is a second perspective schematic diagram of a lighting device according to a specific embodiment of the present disclosure.

Referring to FIG. 1 to FIG. 4, as shown in FIG. 1 to FIG. 3, a lighting device 100 provided by the present disclosure includes a housing 101, a light emitting module 102, a press plate 103 and a fixing member 104. The housing 101 has a bottom plate 105, a base 106 and a plurality of stopping portions 107. The base 106 protrudes from one side of the bottom plate 105, and has a top surface 108 and an inclined surface 109 connected between the top surface 108 and the bottom plate 105. The stopping portions 107 are arranged at the bottom plate 105 and extend to a bottom portion of the inclined surface 109 of the base 106. The light emitting module 102 includes a light panel 110 and a plurality of light emitting elements 111 arranged on the light panel 110. The light panel 110 leans on the inclined surface 109 and has stopped portions 112 corresponding to the stopping portions 107. The press plate 103 is located at the top surface 108, and presses against the other side opposite to the side of the light panel 110 of the lighting emitting module 102 provided with the stopped portions 112. The fixing member 104 fixes the press plate 103 at the top surface 108 to cause the press plate 108 to press the light panel 110 downward, so as to fix the light panel 110 on the inclined surface 109. The light emitting elements 111 may be, for example but not limited to, light emitting diode package elements.

Figure 4:
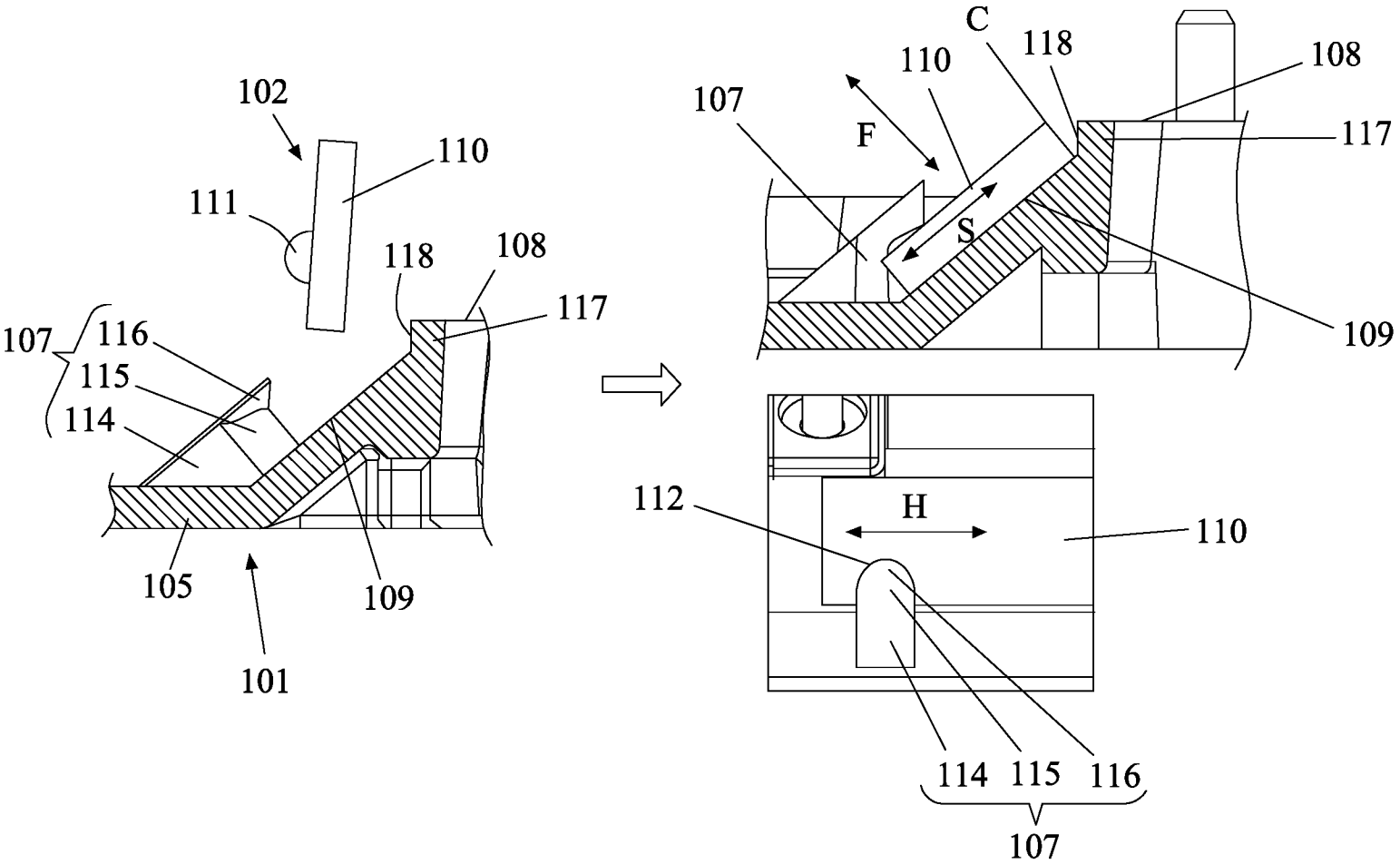
FIG. 4 is a flowchart of an assembly process of a lighting device according to a specific embodiment of the present disclosure.

As shown in FIG. 4, regarding the assembly of the lighting device 100 of the present disclosure, the light panel 110 may be first placed on the inclined surface 109, the stopped portions 112 and the stopping portions 107 are mutually stopped in position, the press plate 103 is placed at the top surface 108, and then the press plate 103 is fixed at the top surface 108 by the fixing member 104, hence quickly and conveniently fixing the light panel 110 at the base 106, so as to solve the issue of being time-consuming and labor-consuming caused by locking of screws one after another during the installation of a light panel in the prior art.

As shown in FIG. 2 and FIG. 3, in one embodiment, the press plate 103 may be a control circuit board, and has a plurality of solder bumps 113 on one side opposite to the light panel 110. The solder bumps 113 and the light panel 110 are electrically connected by a plurality of solder portions 2 in between. A light panel of the prior art is usually connected to a control circuit board by wires, and connectors of these wires frequently suffer from loosening or poor contact. In this embodiment, once the press plate 103 is fixed in position, the solder bumps 113 are close to the light panel 110, and the light panel 110 is then electrically connected to the press plate 103 by means of welding. By implementing the electrical connection between the press plate 103 and the light panel 110 by means of welding, the reliability of the electrical connection is significantly greater than that implemented by plugging or insertion of wires. However, as shown in FIG. 1, the press plate 103 may also be a plate simply providing a press function but not an electrical connection function, such as a plastic plate. In this case, the light panel 110 may be integrated with a control function.

As shown in FIG. 4, in one embodiment, each of the stopping portions 107 includes a first part 114 protruding from the bottom plate 105, and a second part 115 extending from the first part 114 and protruding from the inclined surface 109. Each stopped portion 112 is a concave portion corresponding to the second part 115 of each stopping portion 107. However, the present disclosure is not limited to the above example; for example, the forms of the stopped portions 112 and the stopping portions 107 may also be swapped. Preferably, two sides of the second part 115 are leaned against by two sides of the corresponding stopped portion 112. More specifically, a side surface of the second part 115 may be an arc surface, and each stopped portion 112 may be an arc recess, such that the second part 115 can be clamped by the stopped portion 112 and hence be positioned in a horizontal direction H.

As shown in FIG. 4, in one embodiment, a top portion of the second part 115 may have a press protrusion 116, so as to press against the light panel 110 when the stopped portions 112 and the stopping portions 107 are mutually stopped in position. The press protrusion 116 is capable of pressing a bottom end of the light panel 110 on the inclined surface 109. During the installation of the light emitting module 102, one side of the light panel 110 having the light emitting elements 111 is placed to face upward, and the light panel 110 is slid on the inclined surface 109 at an angle from the inclined surface 109. As the light panel 110 slides downwards, the angle between the light panel 110 and the inclined surface 109 gradually reduces, and the bottom end of the light panel 110 is collaterally pushed between the press protrusion 116 and the inclined surface 109.

Referring to FIG. 4 as well as FIG. 2, in one embodiment, a top portion of the inclined surface 109 may be provided with a limiting portion 117. The limiting portion 117 may have a limiting surface 118 at an angle different from that of the inclined surface 109. In one embodiment, the limiting surface 118 is perpendicular to the top surface 108. A corner C of the light panel 110 close to the top surface 108 is in alignment with the top surface 109, and the corner C is pressed by the press plate 103. With the press plate 103 and the limiting portion 117, a top end of the light panel 110 can be positioned, and at the same time a downward pressing force provided by the press plate 103 on the light panel 110 can generate two divided forces in an inclined surface direction S from the inclined surface 109 to the bottom plate 102 and a normal direction F of the inclined surface 109. Since a bottom portion of the light panel 110 is positioned, total positioning of the light panel 110 is achieved once the press plate 103 is fixed at the top surface 108 by the fixing member 104.

As shown in FIG. 2, in one embodiment, the top surface 108 of the base 105 has a fixing hole 119, the press plate 103 has a through hole 120, and the fixing member 104 passes through the fixing hole 120 and is fixed at the fixing hole. The fixing hole 119 may be a screw hole, and the fixing member 104 may be a screw. It should be noted that the present disclosure is not limited to the above examples. The top surface 108 may be provided with a plurality of guiding protrusions 121, and the press plate 103 may have corresponding guiding through holes 122, such that the through hole 120 is located right above the fixing hole 119 when the press plate 103 is placed at the top surface 108.

The present disclosure is described by way of the preferred embodiments above. A person skilled in the art should understand that, these embodiments are merely for describing the present disclosure and are not to be construed as limitations to the scope of the present disclosure. It should be noted that all equivalent changes, replacements and substitutions made to the embodiments are to be encompassed within the scope of the present disclosure. Therefore, the scope of protection of the present disclosure should be accorded with the broadest interpretation of the appended claims

What is claimed is:

1. A lighting device, comprising:

a housing, having a bottom plate, a base and a plurality of stopping portions, the base protruding from one side of the bottom plate and having a top surface and an inclined surface connected between the top surface and the bottom plate, the plurality of stopping portions arranged at the bottom plate and extending to a bottom portion of the inclined surface of the base;

a light emitting module, comprising a light panel and a plurality of light emitting elements arranged on the light panel, the light panel leaning against the inclined surface, one side of the light panel having stopped portions corresponding to the plurality of stopping portions;

a press plate, located at the top surface, and pressing against one other side opposite to one side of the light panel of the lighting emitting module provided with the stopped portions; and a fixing member, fixing the press plate at the top surface to cause the press plate to press the light panel downward, so as to fix the light panel on the inclined surface.

2. The lighting device according to claim 1, wherein the press plate is a control circuit board and has a plurality of solder bumps on one side opposite to the light panel, and the solder bumps and the light panel are electrically connected by a plurality of solder portions in between.

3. The lighting device according to claim 1, wherein each of the stopping portions comprises a first part protruding from the bottom plate, and a second part extending from the first part and protruding from the inclined surface, and each of the stopped portions is a concave portion corresponding to the second part of each stopping portion.

4. The lighting device according to claim 3, wherein two sides of the second part are leaned against by two sides of the corresponding stopped portion.

5. The lighting device according to claim 3, wherein a side surface of the second part is an arc surface, and each of the stopped portion is an arc recess.

6. The lighting device according to claim 3, wherein a top portion of the second part has a press protrusion, so as to press against a top surface of the light panel when the stopped portions and the stopping portions are mutually stopped in position.

7. The lighting device according to claim 1, wherein a top portion of the inclined surface is provided with a limiting portion.

8. The lighting device according to claim 7, wherein the limiting portion has a limiting surface at an angle different from that of the inclined surface.

9. The lighting device according to claim 8, wherein the limiting surface is perpendicular to the top surface.

10. The lighting device according to claim 1, wherein a corner of the light panel close to the top surface is in alignment with the top surface, and the corner is pressed by the press plate.

11. The lighting device according to claim 1, wherein the top surface of the base has a fixing hole, the press plate has a through hole, and the fixing member passes through the fixing hole and is fixed at the fixing hole.

12. The lighting device according to claim 11, wherein the fixing hole is a screw hole and the fixing member is a screw.

13. The lighting device according to claim 11, wherein the top surface is provided with a plurality of guiding protrusions, and the press plate has corresponding guiding through holes, such that the through hole is located right above the fixing hole when the press plate is placed at the top surface.

* * * * *